US005573852A

United States Patent [19]

Thal

[11] Patent Number: 5,573,852

[45] Date of Patent: Nov. 12, 1996

[54] TENSIONING BUNDLES COMPRISING A PLURALITY OF TENSIONING MEMBERS SUCH AS STRANDED WIRES, RODS OR SINGLE WIRES

[75] Inventor: Hermann Thal, Mondsee, Austria

[73] Assignee: Vorspann-Technik Gesellschaft m.b.H., Salzburg, Austria

[21] Appl. No.: 451,384

[22] Filed: May 26, 1995

Related U.S. Application Data

[63] Continuation of Ser. No. 985,507, Dec. 2, 1992, abandoned, which is a continuation of Ser. No. 507,499, Apr. 11, 1990, abandoned.

[30] Foreign Application Priority Data

Apr. 12, 1989 [AT] Austria ..... 863/89
Jun. 6, 1989 [AT] Austria ..... 1383/89

[51] Int. Cl.[6] ..... D02G 3/00

[52] U.S. Cl. ..... 428/378; 428/375; 428/373; 428/374; 428/383; 52/223.1; 52/223.8; 52/309.16

[58] Field of Search ..... 428/375, 373, 428/374, 378, 383; 14/22; 57/902, 217, 221

[56] References Cited

U.S. PATENT DOCUMENTS

| | | | |
|---|---|---|---|
| 2,659,932 | 11/1953 | McNamee | 425/114 |
| 2,979,431 | 4/1961 | Perrault | 156/244.12 |
| 3,461,490 | 8/1969 | Cottingham | 425/113 |
| 3,646,748 | 3/1972 | Lang | 57/164 |
| 3,659,633 | 5/1972 | Durkee et al. | 14/22 |
| 3,681,911 | 8/1972 | Humphries | 428/378 |
| 3,922,437 | 11/1975 | Kitta et al. | 428/383 |
| 4,123,894 | 11/1978 | Hughes et al. | 428/378 |
| 4,612,680 | 9/1986 | Daiguji | 14/22 |
| 4,633,540 | 1/1987 | Jungwirth et al. | 14/22 |
| 4,643,929 | 2/1987 | Watanabe et al. | 428/379 |
| 4,661,387 | 4/1987 | Watanabe et al. | 428/383 |
| 4,718,965 | 1/1988 | Finsterwalder et al. | 14/22 |
| 4,776,161 | 10/1988 | Sato et al. | 428/383 |
| 4,960,641 | 10/1990 | Hanaoka et al. | 428/391 |

FOREIGN PATENT DOCUMENTS

| | | | |
|---|---|---|---|
| 168488 | 6/1951 | Austria . | |
| 501611 | 3/1951 | Belgium . | |
| 0154243 | 9/1985 | European Pat. Off. . | |
| 0073170 | 11/1986 | European Pat. Off. . | |
| 1044844 | 11/1953 | France . | |
| 1556189 | 1/1969 | France . | |
| 7137270 | 6/1972 | France . | |
| 8701692 | 8/1988 | France . | |
| 1559568 | 2/1970 | Germany . | |
| 2114863 | 8/1972 | Germany | 14/22 |
| 2557511 | 7/1976 | Germany . | |
| 2455273 | 8/1977 | Germany . | |
| 3424737 | 8/1985 | Germany . | |
| 3418318 | 11/1985 | Germany . | |
| 3437107 | 4/1986 | Germany | 14/22 |
| 203390B | 8/1987 | Hungary . | |
| 1241849 | 8/1971 | United Kingdom . | |
| 2140480 | 11/1984 | United Kingdom . | |
| 85/05394 | 12/1985 | WIPO . | |
| WO88/09847 | 12/1988 | WIPO . | |
| 88/09847 | 12/1988 | WIPO . | |

*Primary Examiner*—Patrick Ryan
*Assistant Examiner*—Jill M. Gray
*Attorney, Agent, or Firm*—Keck, Mahin & Cate

[57] ABSTRACT

Tensioning bundle includes tensioning members running parallel to one another such as stranded wires or single wires. According to the invention the tensioning bundle as a whole is covered with at least one synthetic resin in an extruder. For tensioning such bundles the tensioning members may be tensioned individually or jointly.

11 Claims, 3 Drawing Sheets

TENSIONING BUNDLES COMPRISING A PLURALITY OF TENSIONING MEMBERS SUCH AS STRANDED WIRES, RODS OR SINGLE WIRES

This is a continuation of U.S. patent application Ser. No. 07/985,507, filed on Dec. 2, 1992, now abandoned which is a continuation of U.S. patent application Ser. No. 07/507,499, filed Apr. 11, 1990, now abandoned.

The invention also relates to a process for tensioning such tensioning bundles.

Up to now it was conventional regarding the manufacture of such bundles to provide the stranded wires or wires individually with a synthetic resin covering, e.g. made of polyethylene, a grease coating or a galvanic coating and to then bundle several of such stranded wires or wires. It is further known to galvanically coat or grease the stranded wires or wires prior to covering them with synthetic resin. Such stranded wires or wires can move within the synthetic resin covering. The disadvantage of the bundling of the stranded wires or wires coated with synthetic resin lies in the fact that a relatively thick bundle is obtained.

Furthermore tensioning members consisting of rods, wires or stranded wires, Individual or bundled, were carried in enveloping pipes of sheet metal or synthetic resin the filling of the cavity between the tensioning members and the enveloping pipe being effected by means of cement or so-called permanently plastic substances by pressing in the filling material before the tensioning of the tensioning members or thereafter.

At their ends the tensioning members were provided with anchoring means and were tensioned. They can be accommodated inside or outside a supporting structure; in the latter case the enveloping pipe itself must also be made of corrosion-resistant material.

The disadvantages of the known processes were often the corrosion protection for which an operating process of its own was necessary resulting in high time consumption and expenditures. Also, the risk of faults in protecting the tension members was not inconsiderable. Disadvantages arising from the rods, wires or stranded wires touching at deflecting regions of the tensioning members which resulted in increased friction during pretensioning and thus losses of pretensioning forces as well as reduction of strength, in particular fatigue strength, must also be mentioned.

OBJECTS AND THE INVENTION AND GENERAL DESCRIPTION

It is the object of the invention to provide measures by which, whilst avoiding this disadvantage, the space requirements for the tensioning bundle are minimized and the latter can furthermore be manufactured in a more labour saving way than previously.

To attain this object the invention proposes that the tensioning members in the bundle run parallel to one another and are jointly covered by a synthetic resin.

In the case of cables for electrical installations it is indeed known to envelope several insulated wires with a joint synthetic resin covering. Apart from the fact that these cables are not intended for reinforcing concrete, the wires Inside them do not run parallel but are joined in a plait.

According to a further feature of the invention, the stranded wires or wires are provided, preferably in an extruder, with a corrosion-protecting and/or lubricating material, e.g. grease and/or a galvanic coating and/or a thin coating of hard synthetic resin prior to the covering being applied.

When applying the synthetic resin, the stranded wires or wires often lie in such a way that the synthetic resin can also penetrate between the stranded wires or wires whereupon the bundle is compressed in order to attain the desired small diameter. In this context it may happen that the covering does not adopt the exact desired surface outlines. In order to avoid this risk, the invention proposes the application of a second covering of synthetic resin. This covering can bond homogeneously with the first covering so that an integral covering is formed.

According to a further feature of the invention it is also possible to manufacture the second covering in a synthetic resin different from the first covering.

With such bundles difficulties may also arise with regard to the characteristics during bending or rolling up. By using harder synthetic resin, respectively a thicker layer of soft resin in applications where a stronger protection of the stranded wires by the covering is required, an excessive load may result in the case of excessive bending and resultant damage to the covering, or the bundle cannot be rolled to sufficiently small dimensions as required e.g. for transport purposes.

It is therefore an additional object of the invention to provide measures by which the tensioning bundles are provided with sufficiently protecting coverings which can be rolled to sufficiently small dimensions.

In order to solve this problem a further feature according to the invention proposes that the stranded wires or wires are provided with an inner covering made of soft synthetic resin and an outer covering of a harder synthetic resin.

Within the scope of the invention the stranded wires or wires can be provided with a plurality of concentric coverings of synthetic resin a lubricating layer being provided between at least two coverings, permitting the bundle with the inner covering to move during tensioning thereof in relation to the outer covering.

The coverings and optionally also the lubricating layer are applied by successive extruders.

In the case of buildings where several stranded wires have to be laid next to one another, it is advisable to combine the stranded wires with the preferably soft synthetic resin into a tape.

Finally it is the object of the invention to eliminate the above mentioned disadvantages of the known processes. This object is attained by the tensioning bundle according to the invention, the rods, wires or stranded wires being tensioned individually or jointly.

Further objects and embodiments according to the invention are evident from the following description in which examples of tensioning bundles according to the invention are explained in more detail with reference to drawings.

DESCRIPTION OF SPECIFIC EMBODIMENTS

In this context FIGS. 1 to 3 and 5 to 9 show only one of the stranded wires whereas the remaining stranded wires are indicated in a simplified manner by a circle only.

Figure 1:
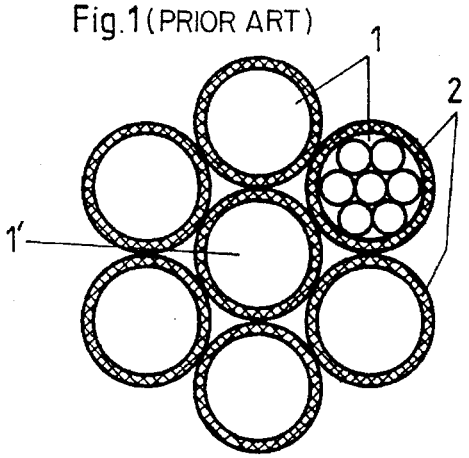
Fig.1 (PRIOR ART)
FIG. 1 shows a previously known design of a stranded wire bundle with individual plastics coated stranded wires in cross section, FIGS. 2 and 3 each show a cross section through a stranded wire bundle according to the invention.

FIG. 1 shows a known stranded wire bundle. This comprises individual stranded wires 1 which are each individually provided with a synthetic resin covering 2. In the example shown, six such stranded wires 1 are arranged around a central stranded wire 1' parallel to one another. Such a stranded wire bundle has to occupy relatively much space when used as a pretensioned stranded wire bundle due to the covering 2 separately applied onto each stranded wire 1, respectively 1'.

Figure 2:
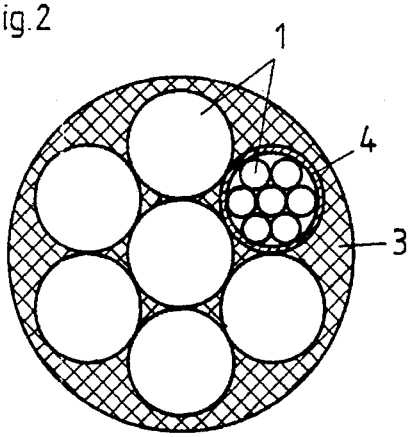

The bundle shown in cross section in FIG. 2 has stranded wires running parallel to one another, as provided according to the invention and has been injection coated as a whole with preferably soft synthetic resin, e.g. polyethylene, by means of an extruder causing the synthetic resin 3 to form a coating as well as penetrating into the spaces between the stranded wires 1. Before applying the covering of soft synthetic resin, the stranded wires may be dry, they can however, as illustrated, also receive a coating 4 serving as corrosion protection, composed of grease, a hard synthetic resin or applied by galvanic alloy. This coating, in particular if it consists of grease, may also fill out the inner spaces between the tensioning members.

FIG. 2 shows a wrap of stranded wires arranged around a central stranded wire. It is, however, also possible to superimpose any number of wraps over one another.

Figure 3:
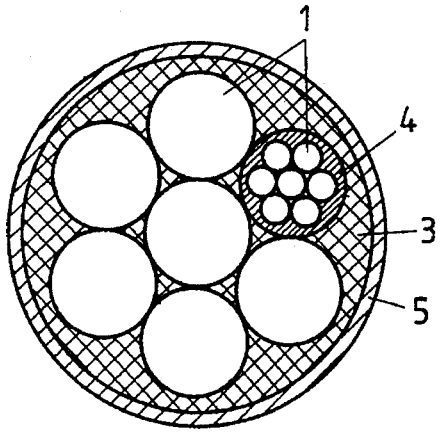

In FIG. 3 the bundle of parallel stranded wires 1 is enveloped by a double-layered covering, respectively by two concentrical coverings 3, 5. The covering is preferably effected in two stages by means of two extruders. In this context it is advisable to first fill the space between the stranded wires 1 and in such a way that the distance of the stranded wires is greater than in the final stage, whereby the synthetic resin also penetrates into the space between the inner stranded wire, and the stranded wires surrounding it, whereupon the stranded wires are compressed to attain the smallest possible diameter of the covered bundle.

In a second stage the outer synthetic resin covering 5 is applied so that a round covered bundle arises.

The two synthetic resins may be selected optionally according to the desired characteristics of the covered bundle. Thus it is possible to make both coverings of the same synthetic resin or the inner covering 3 of a synthetic resin softer than the outer covering 5. This process is preferably effected by successive extrusions of two extruders set up in series. It stands to reason that within the scope of the invention the inner covering may be made of a synthetic resin harder than the outer covering.

According to a further feature of the invention a lubricant may be included between the two coverings 3 and 5, or rather between the outer covering 5 and a further concentric covering, making it possible during tensioning of the bundle for the bundle with the inner covering to move relative to the outer covering. This kind of covering may also be applied in an extrusion process.

Figure 4:
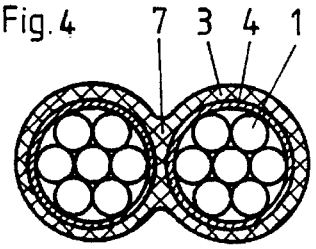
FIGS. 4 to 9 show cross sections through further embodiments of the means according to the Invention and FIG. 10 shows an embodiment of an end of such a bundle with the anchoring means.
Figure 5:
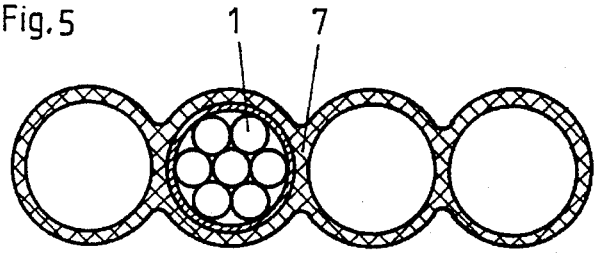
Figure 6:
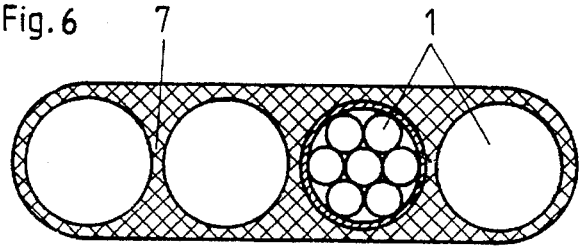

Often it is necessary, however, to accommodate several stranded wires next to one another. In this case the stranded wires 1 may be enveloped by the envelope 4 and be united to a tape next to one another by the synthetic resin 3. In FIG. 4 the tape consists of two and in FIGS. 5 and 6 of four stranded wires, FIG. 6 showing a tape with a covering different from that of FIG. 5. In the embodiments according to FIGS. 4 to 6 the stranded wires 1 are separated from one another by longitudinal webs 7 of the covering.

It is, however, also possible to arrange the stranded wires closely touching one another so that the webs 7 become inapplicable.

Figure 7:
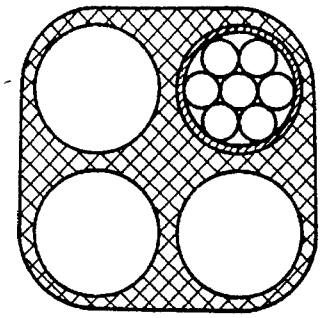
Figure 8:
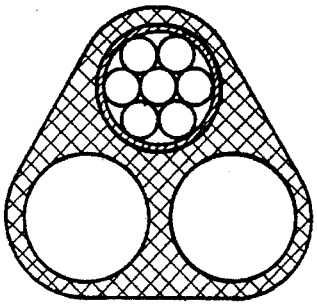
Figure 9:
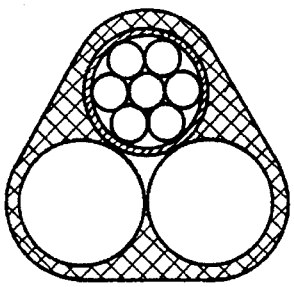

It is left to the designer to arrange the stranded wires parallel to one another, into other cross sectional configurations of the stranded wire bundles, as is shown for example in FIGS. 7 to 9.

Within the scope of the invention the number and the cross sectional shape of the superimposed coverings as well as the number of coatings of lubricants between each two coverings are not limited.

This permits the outer shapes of the bundles to be optionally designed and to be accommodated in a very space-saving manner both within a building structure as well as along its outer wall.

Instead of stranded wires single wires may also be combined to a bundle within the scope of the invention, and such single wires may, prior to the application of the covering with the soft synthetic resin, be provided with a galvanic coating or a coating of grease or thin hard synthetic resin. For anchoring purposes the ends of the bundles so obtained are stripped of the synthetic resin covering, the surfaces of the stranded wires being cleaned so that they can then be bonded by concreting, casting or clamping.

Figure 10:
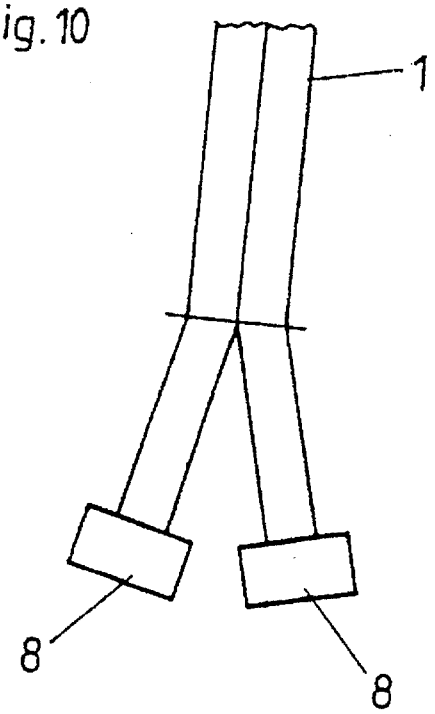

For anchoring the stranded wires, the end of the bundle may be split open as shown in FIG. 10, and each end of the stranded wire, respectively the tensioning member is provided with its own anchoring means 8. Naturally it is also possible to anchor both ends in a joint anchoring plate. Although in the present case a bundle of only two stranded wires is shown, in the same way bundles consisting of more than two tensioning members, may likewise be separated into individual members.

The bundles according to the invention are used for example for the pretensioning of supporting structures with external or internal accommodation of the bundles, for ground anchors or as diagonal cables, e.g. in the case of suspended bridges. Inter alia they also have the advantage that they can adapt to any desired course.

What we claim is:

1. A tensioning bundle comprises a plurality of tensioning members running parallel to one another, each tensioning member being formed as a stranded wire provided with a lubricant coating tightly enclosing at least an outside thereof, all of said tensioning members in said tensioning bundle being jointly covered by at least one covering consisting essentially of synthetic resin material, said at least one covering being extruded by means of an extruder and forming a covering tightly enclosing the plurality of tensioning members, wherein said tensioning members in the tensioning bundle are disposed together for tensioning individually and jointly within said at least one covering.

2. Tensioning bundle according to claim 1, wherein the synthetic resin covering penetrates into the spaces between the tensioning members.

3. Tensioning bundle according to claim 1, wherein the synthetic resin covering comprises a soft synthetic resin.

4. Tensioning bundle according to claim 3, wherein the soft synthetic resin is polyethylene.

5. Tensioning bundle according to claim 1, wherein the lubricant coating of each stranded wire comprises grease.

6. Tensioning bundle according to claim 1, wherein the covering forms a connecting web around the plurality of the tensioning members.

7. Tensioning bundle according to claim 1, wherein the covering comprises a plurality of superimposed synthetic resin covering layers.

8. Tensioning bundle according to claim 7, wherein at least one inner covering layer comprises a soft synthetic resin and at least one outer synthetic resin covering layer comprises a harder synthetic resin.

9. Tensioning bundle according to claim 7, comprising a lubricant layer between each of said synthetic resin covering layers.

10. Tensioning bundle according to claim 1, wherein the plurality of tensioning members are arranged to lie in a line and are connected by a web formed by the synthetic resin covering enveloping the plurality of tensioning members.

11. Tensioning bundle according to claim 1, wherein each of the tensioning members is enveloped by inner and outer concentric coverings, and a layer of lubricant coating is disposed between the inner covering and the outer covering.

* * * * *